US006138324A

United States Patent [19]

Lin

[11] Patent Number: 6,138,324

[45] Date of Patent: Oct. 31, 2000

[54] CURTAIN TRACK

[76] Inventor: Shean Jang Lin, No. 4-31, Nantzu Jiow St. Nantzu Dist., Kaohsiung, Taiwan

[21] Appl. No.: 09/310,528

[22] Filed: May 12, 1999

[30] Foreign Application Priority Data

Sep. 14, 1998 [TW] Taiwan ..... 87215160

[51] Int. Cl.[7] ..... E05D 15/06

[52] U.S. Cl. ..... 16/87.6 R; 16/94 R; 16/87.4 R; 160/330

[58] Field of Search ..... 16/87.6 R, 87.4 R, 16/89, 90, 94 R, 95 R; 49/409, 410; 160/330, 22, 23, 345

[56] References Cited

U.S. PATENT DOCUMENTS

| | | | |
|---|---|---|---|
| D. 266,143 | 9/1982 | Smith | 16/94 R |
| D. 337,257 | 7/1993 | Danieli | 16/94 R |
| 2,513,089 | 6/1950 | Ferris | 16/90 |
| 3,636,588 | 1/1972 | Ferris | 16/90 |
| 4,190,927 | 3/1980 | Hepperle | 160/330 |
| 4,782,554 | 11/1988 | Lawson | 16/87.4 R |
| 5,259,520 | 11/1993 | Roggio et al. | 16/94 D |
| 5,598,666 | 2/1997 | Kurth | 49/409 |

*Primary Examiner*—Anthony Knight
*Assistant Examiner*—Mark Williams
*Attorney, Agent, or Firm*—Pro-Techtor International Services

[57] ABSTRACT

A curtain track, which includes a cylindrical metal profile track, the track having three longitudinal coupling grooves and one longitudinal sliding slot equiangularly spaced around the periphery thereof, and two end brackets for holding the track on a support wall, each end bracket having a mounting frame for fastening to a support wall and a coupling tube axially extended from one end of the mounting frame to hold one end of the track, the coupling tube having a longitudinal opening of width over 90° angle through which carriers are inserted and hung on the longitudinal sliding slot at the track to hold a curtain, an elongated coupling portion extended in longitudinal direction and curved inwards and selectively longitudinally engaged into one of the longitudinal coupling grooves at the track to stop the track from rotary motion relative to the end brackets, and a stop strip transversely provided at one end thereof adjacent to the mounting frame and projecting into the longitudinal opening in the coupling tube at one side to limit movement of installed carriers in the longitudinal sliding slot.

4 Claims, 6 Drawing Sheets

CURTAIN TRACK

BACKGROUND OF THE INVENTION

The present invention relates to a curtain track, and more particularly to such a curtain track which can be used with J-type carriers, M-type carriers, double M-type carriers, as well as rings to hold a curtain.

A variety of curtain tracks and curtain poles have been disclosed, and have appeared on the market. FIG. 1 shows a curtain track according to the prior art. This structure of curtain track comprises a track 10, which has a substantially J-shaped cross section and defines a longitudinal sliding slot 101 at one lateral side, two end brackets 20 respectively connected to two opposite ends of the track 10, each end bracket 20 comprising a mounting frame 201, which is fastened to the wall, a coupling portion 202 which is sleeved onto one end of the track 10, and a stop rod 203, which projects into the longitudinal sliding slot 101 from one end, a plurality of J-type carriers 30 mounted in the longitudinal sliding slot 101 and moved along the track 10 between the stop rod 203 at each end bracket 20, a curtain 100 suspended from the J-type carriers 30, two pulleys 204 at one end bracket 20, and operating cords 205 suspended from the pulleys 204 and operated to move the carriers 30. FIG. 2 shows another structure of curtain track according to the prior art. This structure of curtain track comprises a track 40 having a longitudinal sliding slot 401 at the bottom, two end brackets 50 for securing the track 40 to the wall, each end bracket 50 having a coupling portion 501, which holds one end of the track 40, and M-type carriers 502 installed in the track 40 to hold a curtain (not shown) and moved along the longitudinal sliding slot 401. FIG. 3 is a cross-sectional view of still another structure of curtain track according to the prior art, in which M-type carriers 502 are suspended from the track 60 at the bottom. FIG. 4 shows a curtain pole according to the prior art. This structure of curtain pole comprises a pole 70, two block brackets 80, which hold the pole 70 on the wall, and a plurality of rings 90 mounted on the pole 70 to hold a curtain. In the aforesaid curtain tracks and curtain pole, the accessories and parts are not exchangeable, i.e., the rings 90 and block brackets 80 cannot be used with the track of either of the aforesaid prior art curtain tracks, the M-type carriers 502 shown in FIG. 2 cannot be used with the track 10 shown in FIG. 1, the J-type carriers 30 shown in FIG. 1 cannot be used in the track 50 shown in FIG. 2 or the track 60 shown in FIG. 3.

SUMMARY OF THE INVENTION

The present invention has been accomplished under the circumstances in view. It is the main object of the present invention to provide a curtain track which can be arranged to match with either J-type carriers or M-type carriers as desired. It is another object of the present invention to provide a track for curtain track which can be used with end blocks and rings, forming a curtain pole. To achieve these and other objects of the present invention and according to one embodiment of the present invention, there is provided a curtain track comprised of a track made of a cylindrical metal profile for the mounting of rings/carriers to hold a curtain, and two end brackets respectively installed in a support wall to hold the track in place, wherein the track comprises three longitudinal coupling grooves and one longitudinal sliding slot equiangularly spaced around the periphery thereof; the end brackets each comprise a mounting frame for fastening to a support wall, and a coupling tube axially extended from one end of the mounting frame to hold one end of the track, the coupling tube comprising a longitudinal opening of width over 90° angle through which carriers are inserted and hung on the longitudinal sliding slot at the track to hold a curtain, an elongated coupling portion extended in longitudinal direction and curved inwards and longitudinally engaged into one longitudinal coupling groove at the track to stop the track from rotary motion relative to the end brackets, and a stop strip transversely provided at one end thereof adjacent to the mounting frame and projecting into the longitudinal opening in the coupling tube at one side to limit the movement of installed carriers in the longitudinal sliding slot.

DETAILED DESCRIPTION OF THE PREFERRED EMBODIMENT

Figure 1:
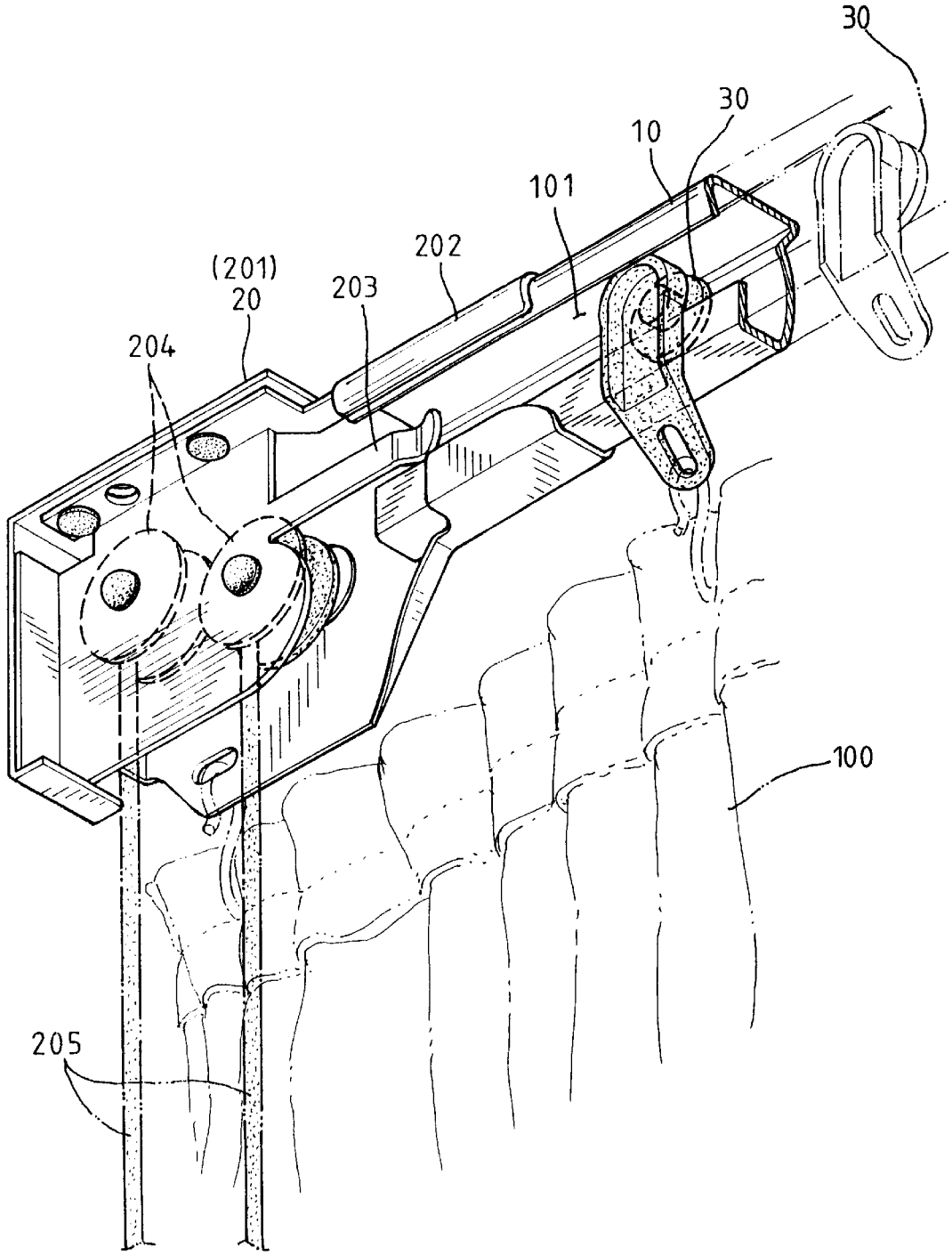
FIG.1 PRIOR ART
FIG. 1 illustrates a curtain track equipped with J type carriers to hold a curtain according to the prior art.
Figure 2:
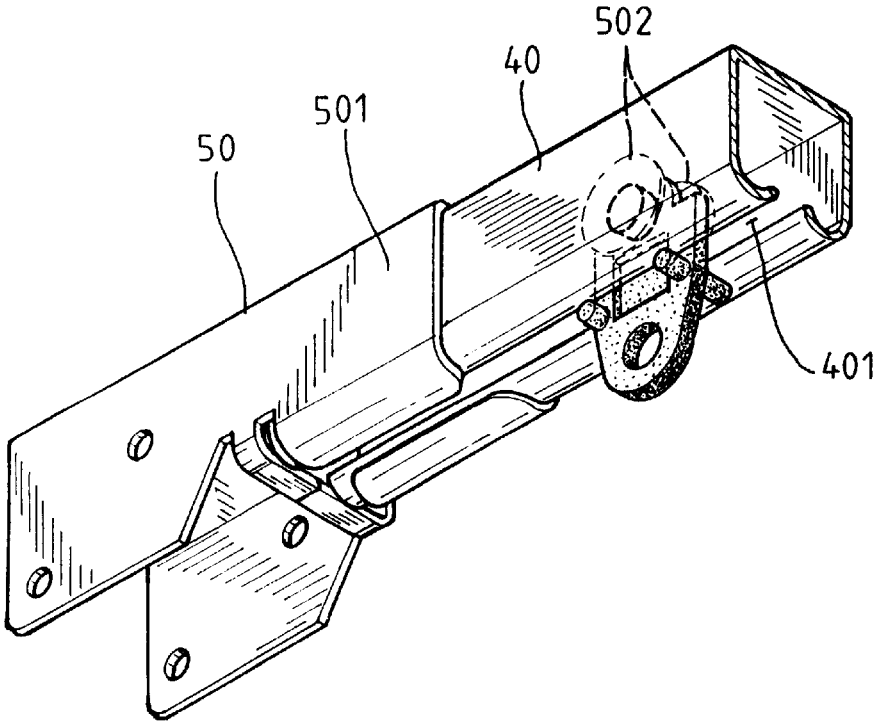
FIG. 2 PRIOR ART
FIG. 2 illustrates another structure of curtain track equipped with M type carriers according to the prior art.
Figure 3:
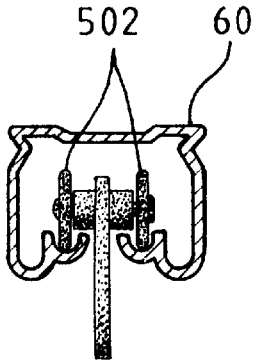
FIG.3 PRIOR ART
FIG. 3 is a cross sectional view of still another structure of curtain track according to the prior art.
Figure 4:
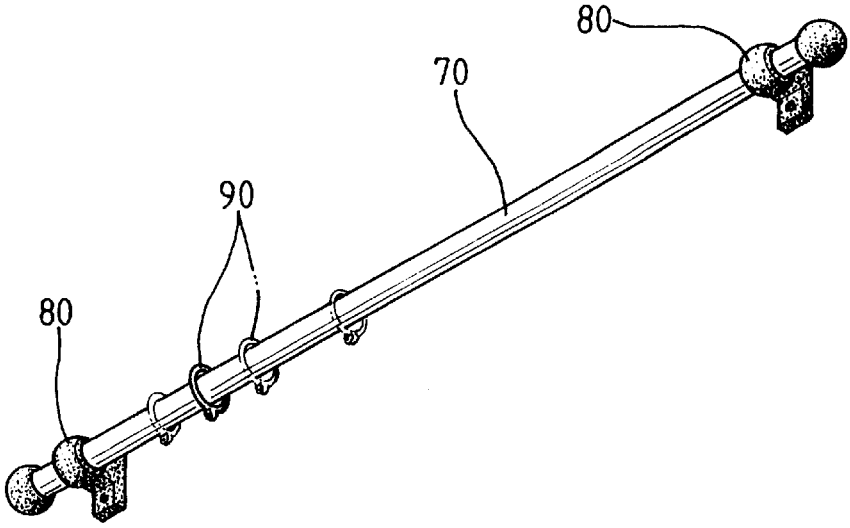
FIG. 4 PRIOR ART
FIG. 4 is illustrates a curtain pole according to the prior art.
Figure 5:
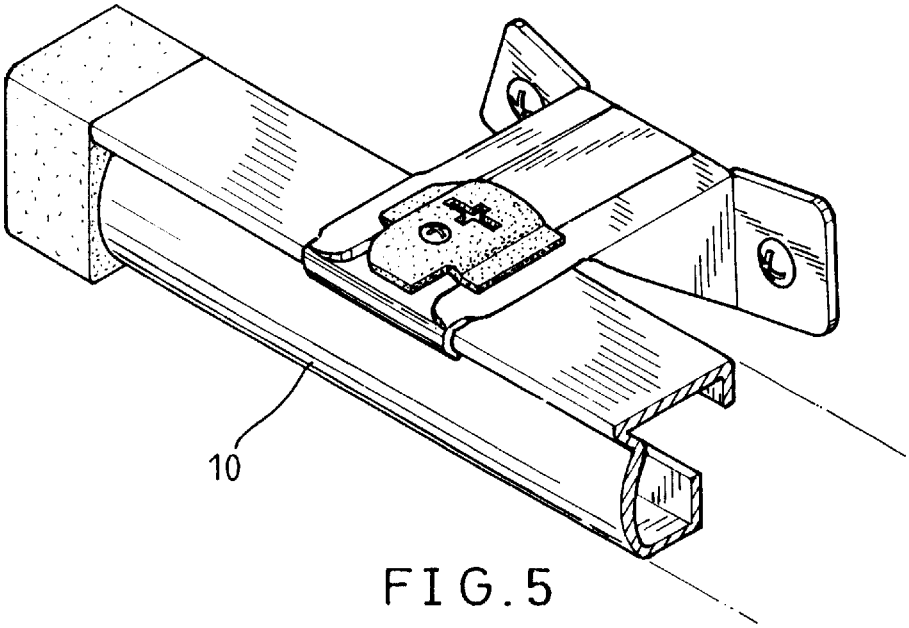
FIG. 5 PRIOR ART
FIG. 5 illustrates still another structure of curtain track according to the prior art.
Figure 6:
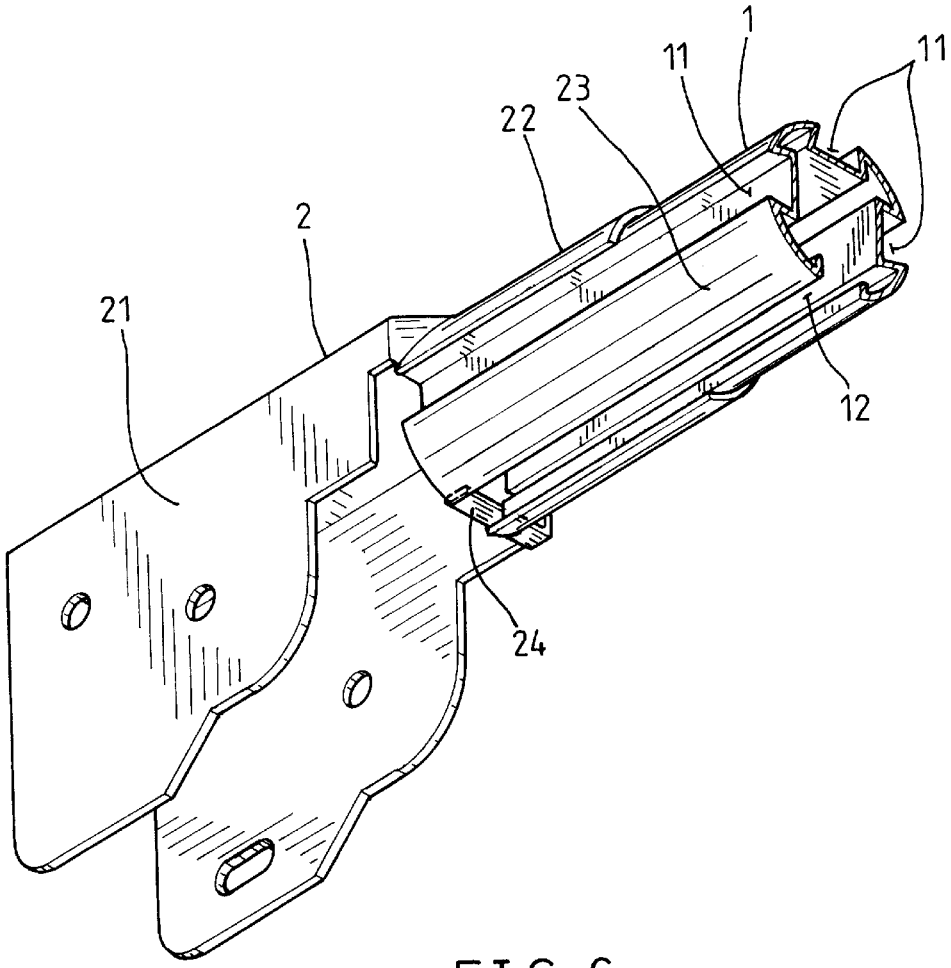
FIG. 6 is a perspective assembly view of a part of a curtain track according to the present invention.

Referring to FIG. 6, a curtain track in accordance with the present invention is comprised of a track 1, and two end brackets 2 at two opposite ends of the track 1 (in the drawings, there is shown only one end bracket 2 at one end of the track 1).

Figure 7:
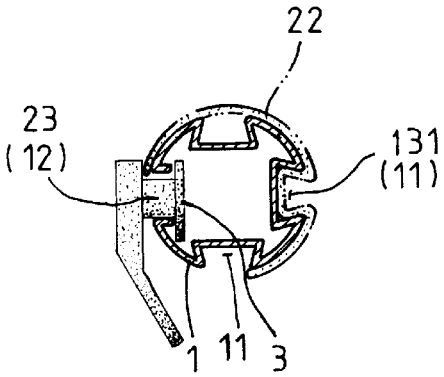
FIG. 7 is a cross-sectional view of an application example of the present invention showing J-type carriers installed in the track.
Figure 8:
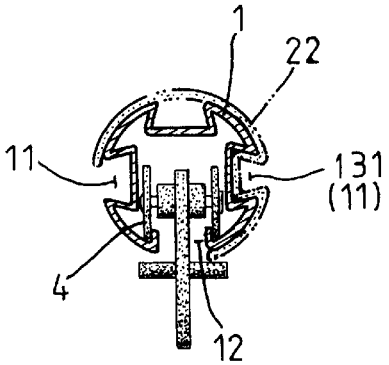
FIG. 8 is a cross-sectional view of another application example of the present invention showing M-type carriers installed in the track.

Referring to FIGS. 7 and 8 and FIG. 6 again, the track 1 is a cylindrical metal profile having three longitudinal coupling grooves 11 and one longitudinal sliding slot 12 equiangularly spaced around the periphery. The end bracket 2 comprises a mounting frame 21, and a coupling tube 22 axially extended from one end of the mounting frame 21. The coupling tube 22 comprises a longitudinal opening 23 of width over 90°, an elongated coupling portion 131 extended in longitudinal direction and curved inwards, and a stop strip 24 transversely provided at its one end adjacent to the mounting frame 21 and projecting into the longitudinal opening 23 at one side to limit movement of installed carriers in the longitudinal sliding slot 12 at the track 1. The two opposite ends of the track 1 are respectively into the coupling tube 22 at each of the end brackets 2, enabling the elongated coupling portion 131 of the coupling tube 22 at each of the end brackets 2 to be respectively engaged into one longitudinal coupling groove 11 at the track 1. Because the elongated coupling portion 131 of the coupling tube 22 at each of the end brackets 2 are respectively engaged into one longitudinal coupling groove 11 at the track 1, the track 1 is prohibited from rotary motion relative to the end brackets 2. Referring to FIG. 7 again, the track 1 can be connected to the end brackets 2 in such a position where the longitudinal sliding slot 12 at the track 1 is disposed at one lateral side, enabling J-type carriers 3 to be inserted through the longitudinal opening 23 at the coupling tube 22 at each of the end brackets 2 and hung on the longitudinal sliding slot 12 at the track 1 for hanging a curtain.

Referring to FIG. 8 again, the track 1 can be connected to the end brackets 2 in such a position where the longitudinal sliding slot 12 at the track 1 is disposed at a bottom side and aimed at the longitudinal opening 23 at the coupling tube 22 at each of the end brackets 2, enabling M-type carriers 4 to be inserted through the longitudinal opening 23 at the coupling tube 22 at each of the end brackets 2 and hung on the longitudinal sliding slot 12 at the track 1 for hanging a curtain.

Figure 9:
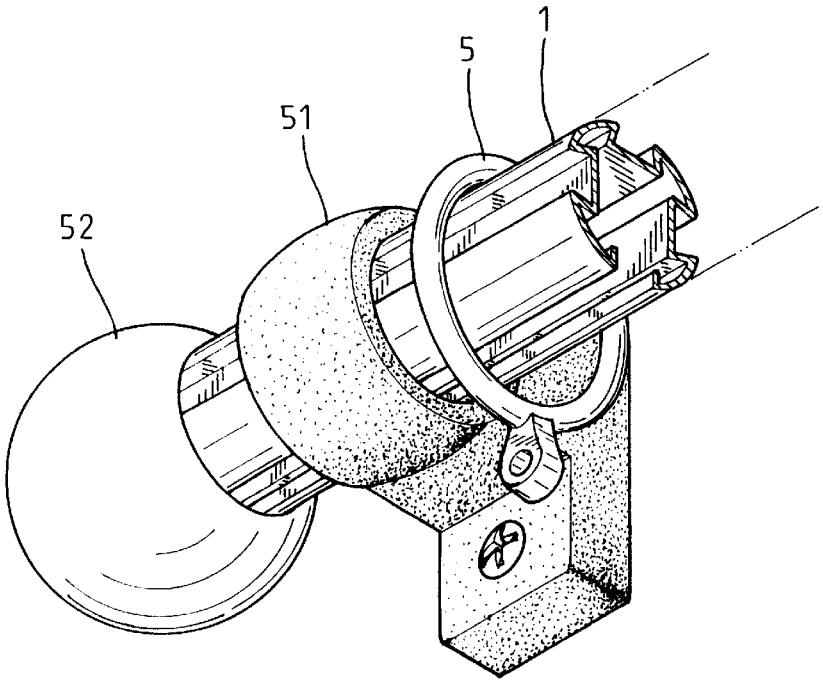
FIG. 9 illustrates the track used with block brackets, rings and end caps.

Referring to FIG. 9, the track 1 can be used with block brackets 50 (which secures the track 1 to the wall), rings 5 (which are hung on and moved along the track 1 to hold a curtain), and end caps 52 (which are fastened to the ends of the track 1 to keep the track 1 in place) to form a curtain pole.

Figure 10:
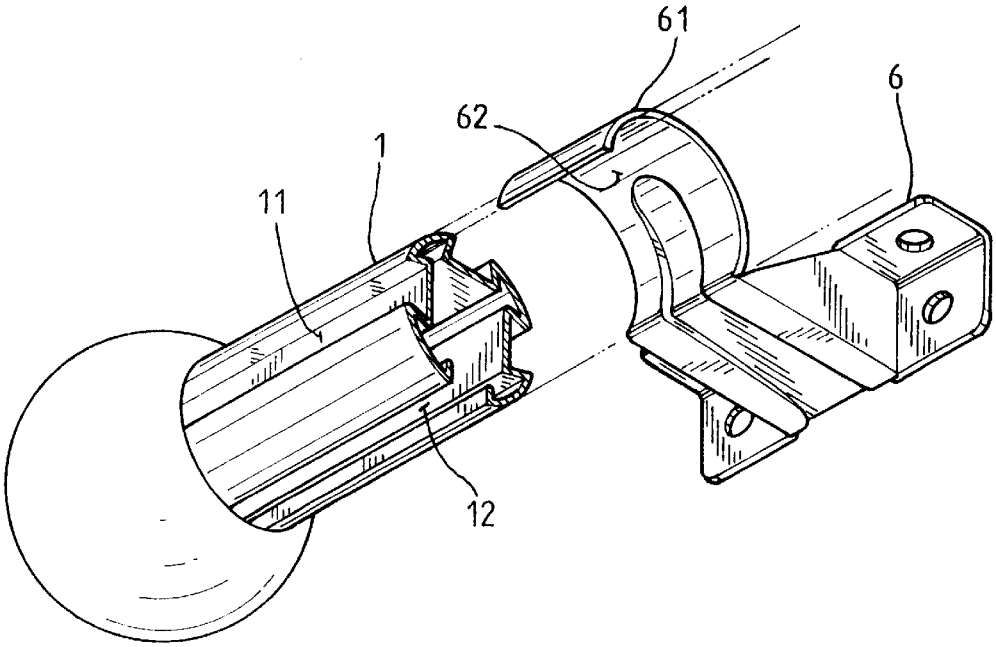
FIG. 10 illustrates the use of a track with a bracket where the bracket has a clamping arm defining a smoothly arched coupling portion according to the present invention.

Referring to FIG. 10, the track 1 can be used with a bracket 6 having a clamping arm 61. The clamping arm 61 defines a smoothly arched coupling portion 62. The angle of the transverse cross-section of the smoothly arched coupling portion 62 is smaller than a semicircle. By forcing the track 1 peripherally into the coupling portion 62, the track 1 is secured to the bracket 6.

Figure 11:
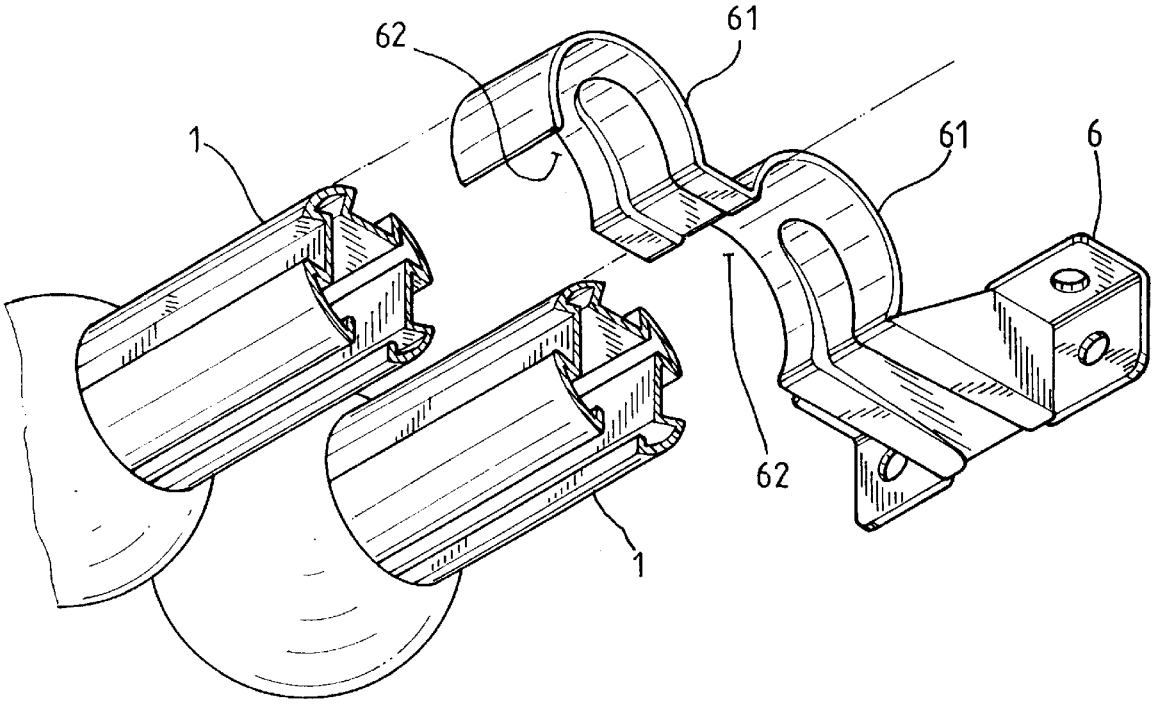
FIG. 11 illustrates the use of two tracks with a bracket where the bracket has a clamping arm defining two smoothly arched coupling portions according to the present invention.

FIG. 11 shows two tracks 1 connected in parallel to a bracket 6 according to the present invention. The bracket 6 comprises a clamping arm 61 defining two arched coupling portions 62 arranged in parallel for engagement with the tracks 1.

It is to be understood that the drawings are designed for purposes of illustration only, and are not intended as a definition of the limits and scope of the invention disclosed.

What the invention claimed is:

1. A curtain track comprising:

a track made of a cylindrical metal profile for the mounting of rings/carriers to hold a curtain, said track comprising three longitudinal coupling grooves and one longitudinal sliding slot equiangularly spaced around the periphery thereof;

two end brackets respectively installed in a support wall to hold said track in place, said end brackets each comprising a mounting frame for fastening to said support wall, and a coupling tube axially extended from one end of said mounting frame to hold one end of said track, said coupling tube comprising a longitudinal opening of width over 90° through which carriers are inserted and hung on the longitudinal sliding slot at said track to hold a curtain, said coupling tube including an elongated coupling portion extended in longitudinal direction and curved inwards and longitudinally engaged into one of said three longitudinal coupling groove at said track to stop said track from rotary motion relative to said end brackets, and a stop strip transversely provided at one end thereof adjacent to said mounting frame and projecting into the longitudinal opening in said coupling tube at one side to limit the movement of installed carriers in said longitudinal sliding slot.

2. The curtain track of claim 1 wherein said end brackets each comprise a clamping arm raised from one side of the respective mounting frame, said clamping arm defining at least one smoothly arched coupling portion for holding a respective second track.

3. The curtain track of claim 2 wherein the angle of the transverse cross-section of said smoothly arched coupling portion is shorter than a semicircle.

4. The curtain track of claim 2 wherein said clamping arm defining a plurality of smoothly arched coupling portions arranged in parallel for holding a respective second track.

* * * * *